US006161257A

United States Patent [19]

Ueding et al.

[11] Patent Number: 6,161,257

[45] Date of Patent: Dec. 19, 2000

[54] PROCESS FOR CAN DELIVERY AND REMOVAL AT A TEXTILE MACHINE

[75] Inventors: Michael Ueding, Ingolstadt; Otmar Kovacs, Berching; Carsten Peter, Ingolstadt, all of Germany

[73] Assignee: Rieter Ingolstadt Spinnereimaschinenbau AG, Ingolstadt, Germany

[21] Appl. No.: 09/290,810

[22] Filed: Apr. 13, 1999

[30] Foreign Application Priority Data

Apr. 30, 1998 [DE] Germany ..... 198 19 376

[51] Int. Cl.[7] ..... D04H 11/00

[52] U.S. Cl. ..... 19/159 A; 19/65 A; 57/90

[58] Field of Search ..... 19/65 A, 159 A, 19/159 R; 57/90, 281; 414/416, 811; 198/433, 346.1, 346.2, 427, 430, 465.1; 53/250, 251, 252, 116, 118

[56] References Cited

U.S. PATENT DOCUMENTS

| | | | |
|---|---|---|---|
| 3,443,287 | 5/1969 | Hertzsch . | |
| 4,059,185 | 11/1977 | Weber . | |
| 5,276,947 | 1/1994 | Fritschi et al. | 19/159 A |
| 5,396,682 | 3/1995 | Lamprecht | 19/159 A |
| 5,632,138 | 5/1997 | Liedgens | 57/281 |
| 5,634,316 | 6/1997 | Leifeld | 19/159 A |
| 5,664,398 | 9/1997 | Leifeld | 19/159 A |
| 5,682,647 | 11/1997 | Leifeld | 19/159 A |
| 5,687,454 | 11/1997 | Langen | 19/159 A |
| 5,729,868 | 3/1998 | Liedgens et al. | 19/159 A |
| 5,815,888 | 10/1998 | Temburg | 19/159 A |

OTHER PUBLICATIONS

German Search Report, German Application No. 198 19 376.9, dated Sept. 21, 1998.

*Primary Examiner*—John J. Calvert
*Assistant Examiner*—Gary L. Welch
*Attorney, Agent, or Firm*—Dority & Manning

[57] ABSTRACT

A given plurality of empty round (cylindrical) cans are brought by a can carrier into an empty can magazine of a textile machine which produces a band output. These cans are taken from the can carrier, one after another, to be filled at a filling station from whence filled cans are sequentially moved to a just emptied can carrier in a full can magazine. This can carrier, after the receipt of a given plurality of filled cans, are transported out of the full can magazine. Subsequently, the can carrier, which, in the intervening time, has been emptied and is now to be found in the empty can magazine, is transported by means of an elevated crossover into the full can magazine, which has become free. For the well-timed release of a can carrier loaded with empty cans as well as the transporting of a can carrier from the filling operation loaded with filled cans, there is a Hold Station serving as a buffer zone for an empty can with its can carrier. There is also a Removal Station serving as another buffer station for a loaded can carrier carrying filled cans. Cans other than round ones may be used.

31 Claims, 4 Drawing Sheets

1
40
5
4
20
50
41
2
6
51
32
3
52
31

I
II
41a
41
40
1
32
31
31a
4a
3a
583
582
81
2
20
571
570
57
58
80
580
581
12
3
4
f2
6
52
51
32
40
5
41
50

21
500
340
34
342
9
13
8
f8
f9a
f7
502
420
42
f11
421
503
21a
f14
341
f12
501
760
f13
76
761
f15
f10
830
83
f18
f16
820
82
f17

PROCESS FOR CAN DELIVERY AND REMOVAL AT A TEXTILE MACHINE

BACKGROUND OF THE INVENTION

The present invention concerns a procedure for the transport and placement of empty and full cans using can magazines and can carriers, and also concerns an apparatus for executing the procedure.

Conventionally, for the bringing of empty cans to the filling head of a draw frame, and for the reception of the filled cans in the draw frame, roller conveyors are provided (RIETER-High Capacity Stretch Works RSB 951). The cans to be filled in that method must be taken off from a transport wagon by an operating person, and set upon the roller conveyor. When this is done, because of the required inclination of the roller conveyor, the cans, especially upon being set upon that end of the roller conveyor remote from the draw frame, must be lifted to a relatively high elevation. In the same way, the full cans must be taken off a roller conveyor and placed upon a transport wagon. This method of procedure is thus labor and energy intensive.

Further, from AT 343 047, a device for the supply of a preparatory machine with cans for a spinning works is known. At the beginning, empty cans stand on a transport wagon, and subsequently slide onto a guiding track which leads to a draw frame. The cans, after the filling process, are pushed onto an additional transport wagon by means of a chain with grab arms. For each can, respectively, a grab arm is provided. After the unloading of the first transport wagon, it is moved on further by means of a pushing apparatus. The disadvantage of this arrangement is that the grab arm must insert itself each time between two cans. The cans, for this action, must be exactly positioned as to the distance between them. This alignment is not always possible in the every day work of a spinning factory.

For the pushing of the transport wagons, these must have pivotable wheels.

This is disadvantageous upon manually pushing the wagons, because the pivoted wheels make the wagon too hard to steer. Also, the pushing apparatus is very highly stressed because of the engendered torque which arises from the pushing of the wagon. This stress is the cause of a high degree of wear and tear on the pushing apparatus. As a result, the pushing apparatus must be very ruggedly designed.

OBJECTS AND SUMMARY OF THE INVENTION

All these disadvantages being considered, a primary purpose of the invention is to create a procedure and an apparatus, which eliminate such difficulties.

Additional objects and advantages of the invention will be set forth in part in the following description, or may be obvious from the description, or may be learned through practice of the invention.

These purposes of the invention, so defined, may be achieved by a procedure for the transport of empty cans to a filling station of a textile machine which produces material in bands and the placement of filled cans in a full can magazine, from which the filled cans are removed. In the procedure, a specified number of empty cans is on a can carrier in the empty can magazine of a band producing textile machine. A can to be filled is taken from the can carrier to a filling station from whence the filled can is transported to a just emptied can carrier, which carrier is to be found in the full can magazine. This carrier, after being loaded by a specified plurality of filled cans, is taken out of the full can magazine. The can carrier in the empty can magazine, which carrier in the mean time was emptied, is transported by means of at least a partial lifted crossover which is essentially free of torque damage, into the full can magazine which has just become unoccupied. Since the can carrier remains adjacent to the draw frame or to some other band producing textile machine, while the cans are being filled and the cans after the filling are deposited directly on a can carrier, the work to be carried out in regard to the delivery and removal of the cans to and from the machines by the operator is substantially reduced. The labor and power intensive transfer of two empty cans from the can carrier on a roller conveyor, or, the related removal of full cans from a roller conveyor and the transfer of these heavy cans onto a can carrier may be dispensed with.

A procedural method of restraining in position the can carrier in the empty can magazine and/or in the full can magazine in position is particularly advantageous in order to increase safety measures associated with the transfer of an empty can to a band producing textile machine, or with the removal of a filled can from a band producing machine.

For smooth operation, it is necessary to separate the bringing in of a can carrier to the filling head and the related removal of a can carrier from the output device of the filling head from the in and out transport of can carriers to and from the draw frame. In accord with the invention, there has been provided an additional wait-position which serves as a buffer for the can carrier.

Principally, a can carrier from an empty can magazine, this being the source from which empty cans are routed to the filling head, may be brought into a buffer position from which, upon call, the carrier may once again be removed. The purpose of removal may be to bring the carrier into the full can magazine.

If, however, in a start-up situation, a full can carrier finds itself in the empty can magazine and an empty can carrier finds itself in the full can magazine, then a procedure in accord with the present invention is particularly advantageous. At the very moment when in the empty can magazine the can carrier becomes empty, and also the can carrier in the full can magazine becomes full, the procedure allows that an exchange of the can carrier in the empty can magazine as well as in the full can magazine may be carried out.

For the carrying out of the procedure, an apparatus in accord with the invention for the supply of empty cans to a filling station of a band operating textile machine and for the placement of filled cans into a full can magazine, from which the filled cans are removed. The apparatus provides a supply mechanism for the empty can magazine with the aid of which the cans that find themselves on a can carrier in the can magazine are singly deliverable to the fill station. An elevated crossover system for transfer of an emptied can carrier from the empty can magazine into the full can magazine is also provided, wherein the crossover apparatus lifts up, at least partially, the can carrier and/or transports it over free of torque damage. The acceptance apparatus for respectively one can carrier and its slip restraining facility, as well as regarding run-in as run-out from the filling head, leads to an easing of the labor. By means of the advantageous development of both the empty and full can magazines having a slip restraining facility, a greater degree of safety is assured by the transfer of a can to or from the band operating textile machine.

Advantageously, by allowing the crossover apparatus to be movable underneath the can carrier, a particularly space saving embodiment of the invention has been achieved.

So that not every time, that the can carrier on the feed side of the filling head, has yielded all its empty cans to the filling head, in other words, the can carrier on the discharge side of the filling head is filled with full cans, the operating person or a transport apparatus stand ready with a new can carrier with empty cans or must be ready for the taking away of the can carrier with filled cans, additional unit positions which serve as buffers for the can carrier are advantageously developed.

This development makes possible the setting of a can wagon with empty cans in readiness, or the taking away of a can carrier with full cans, independently of the continual operation of the filling procedure. The adjacency of the hold positions of the empty can and the full can magazines as particularly advantageous in consideration of space relationships as for the manipulation of the can carrier.

The empty cans must be conducted to the filling station. So that an ejection apparatus for the individual cans on their side remote from the filling station can take hold, a run-up ramp extending to await position may be provided.

In order to carry out the transfer of can carriers from one hold position into another position in an especially simple way, using the movable crossover apparatus is particularly advantageous. After a can carrier has been taken away on the pick-up side of the draw frame, and thereby requisite space has been created because of the removal of the can carrier, now all can carriers on the draw frame are moved in common to a hold position.

Principally, the can carrier may be designed in an optional manner, for instance, as a pallet. Nevertheless, the use of can wagons may show itself to be of value. In such a case, a design of the can carrier as a can was on the orientable casters may be advantageous since the pivotable casters may be pulled along during the transfer of the can wagon from one to the next hold position for general availability.

Independently as to whether only one end of the can carrier, or the entire can carrier is lifted for the switching of the same from one place to another, the development that allows the crossover apparatus to interact with a guide, vertically adjustable with a lift apparatus especially in the form of an inflatable hose has shown itself to be particularly a practical improvement.

For a simple and safe manipulation of can handling during the presentation of the can to the filling head, or during the retrieval of the filled can from the filling head, the design of the invented apparatus using guides and installable slip restrain devices is advantageous.

According to the purpose of the application, cans of various sizes may be placed in service. Thus, for instance, cans with diameters ranging between 250 to 600 mm are common. In order not to have to build different equipment for each size of can, the empty can magazine can possess an installable guide to accommodate the width of the can carrier. In this manner, a basic design has been created, wherein by means of a simple readjustment, that is, the adding or removal of guide elements, a fit may be made for the desired can size.

In order to assure that the can carrier crossover transfer can only be carried out, when a number of preliminary conditions have been met, it is advantageous to use monitoring devices in the empty can and full can magazines.

For the easing of can manipulation by pushing the cans where the can carrier is concerned, it is advantageous if the can carrier possesses guide and slip restraint means to keep the cans in an orderly row.

The procedure and the apparatus in accord with the present invention avoid the power consuming and accident hazards related to the run-in to the filling head of the draw frame and can handling at the Removal Station of the filling head. Moreover, excessive wear and tear at these positions is prevented, such as is unavoidable on the setting of cans onto roller conveyors. The invention is also independent of the shape of the can and the procedure finds application not only using round cans, but also in connection with flat or rectangular cans.

The concept of "rectangular can" is not to be limited as it is understood, but is to encompass all shapes of cans. These cans may exhibit a large or small cross-sectional size, independent of the shape of the cross-section. In other words, the concept of the can is independent as to whether or not the ends are constructed by a circular cross-section or the ends conform to straight lines of the walls. Further, the acceptable can shape is independent of the size of possibly provided curvature radii at the transition from a side wall to the bottom of the can.

Embodiments of the invention are presented in the following with the help of the drawings to provide a more complete description and explanation.

DETAILED DESCRIPTION

Figures 1A, 1B, 1C, 1D, 1E, 1F, 2A, 2B, 2C, 2D, 2E:
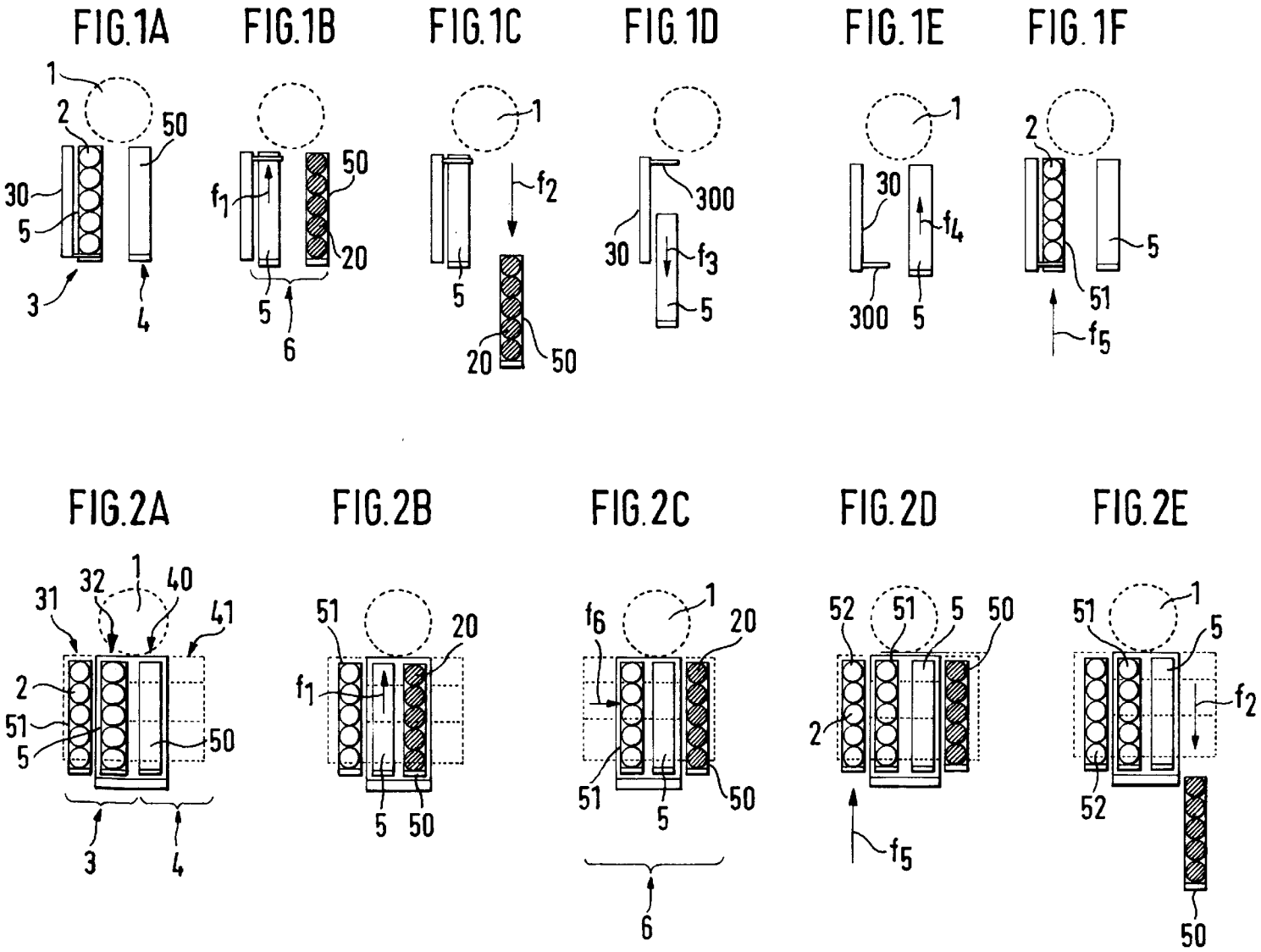
FIGS. 1*a*) to 1*f*) shows a first presentation of the invention in a schematic drawing.
FIGS. 2*a*) to 2*e*) show, in schematic style, a modified presentation of the invention.

Reference will now be made in detail to the presently preferred embodiments of the invention, one or more examples of which are shown in the figures. Each example is provided to explain the invention, and not as a limitation of the invention. In fact, features illustrated or described as part of one embodiment can be used with another embodiment to yield still a further embodiment. It is intended that the present invention cover such modifications and variations.

FIG. 1, with the help of which the procedure in accord with the invention is to be first explained, limits itself to a presentation of the principal, required elements for the carrying out of the procedure.

In FIG. 1, principally the filling station 1 a band yielding textile machine 8 (see FIG. 4) such as, a draw frame is schematically indicated in the form of a dotted circle. To the filling station, a can magazine 6 is attached, which is partitioned first, into an empty can magazine 3 for the supplying of empty cans 2 to the filling station 1 and second, into a full can magazine 4 for the acceptance of the filled cans 20 from the filling station 1. For the supply of empty cans 2 to the filling station 1, a supply mechanism 30 is assigned to the empty can magazine 3. This occurs as the opposite movement of the filled cans 20 into the full can magazine 4 is activated by ejection of the full cans out of the filling station 1.

The individual procedure steps are now explained in more detail with the assistance of FIG. 1*a* to FIG. 1*f*. In the shown start situation of FIG. 1*a*, there is found in the empty can magazine 3 a loaded can carrier 5 with a specified number of empty cans 2 thereon. At this moment, as drawn, empty can carrier 50 stands ready. With the aid of the slupply mechanism 30, the individual empty cans 2 are brought, one after the other, off of the can carrier 5 into the active zone of the filling station 1 (see arrow $f_1$ in FIG. 1*b*). In this zone, the can 2 is filled with fiber band. Subsequently, the once empty can moves now as full can 20 into the full can magazine 4 on the already stationed can carrier 50.

FIG. 1*b* shows that point in time at which the can carrier 5 in the empty can magazine 3 is cleared of empty cans and the can carrier 50, which is in full can magazine 4, is loaded with the specified number of full cans 20. At this moment, the can carrier 50 is brought out of the full can magazine 4 (see arrow $f_2$) and can carrier 50 is conducted to a band working machine (not shown) for further processing (see FIG. 1*c*). Immediately thereupon, the previously emptied can carrier 5 is taken out of the empty can magazine 3 (see arrow $f_3$ in FIG. 1*d*) and conducted to the full can magazine 4 (arrow $f_4$ in FIG. 1*e*).

Into the can magazine 3, which has now become empty by the above actions, a new can carrier 51 loaded with empty cans 2 is brought (see arrow $f_5$ in FIG. 1*f*). This resets the procedure to the original situation in accord with FIG. 1*a* and the describe operation cycle begins anew.

In accord with the described and illustrated procedure, the can carriers 5, each with an entire grouping of empty cans 2 to be transported, are simply run into the empty can magazine on the supply side of the filling station 1 of the band yielding textile machine 8 (see FIG. 4) and left there during the filling process. In this way, the operating personnel is spared very strenuous activity. They need not remove any empty cans 2 from the can carrier 5 in order to conduct them to the empty can magazine 3. Also, they are not required to later take the filled cans 20 out of the full can magazine in order to place them on the can carrier 50.

The remaining work, in the case of the previously described version of the procedure, is the bringing of the can carriers 5, 50, 51 . . . into the empty can magazine 3, the transfer of one of the emptied can carriers 5, 50, 51 . . . out of the empty can magazine 3 into the full can magazine 4, and the retrieval of one of those can carriers 5, 50, 51 . . . out of the full can magazine 4.

However, even the transfer of an emptied can carrier 5 out of the empty can magazine 3 into the full can magazine 4 may be carried out without human involvement. How this is done is depicted in FIG. 2, as a modified embodiment shows. The emptied can carrier 5, found in the empty can magazine 3, is brought into the full can carrier magazine 4, after the release of the full can magazine 4 on the direct way, that is at right angles to the delivery and retrieval direction of the can carrier (see arrow $f_5$ and $f_2$ in FIGS. 2*d*, 2*e*). The means of doing this will be described later in more detail with the aid of FIGS. 3 and 4.

In the case of the embodiment previously described with the help of FIG. 1,

- the transport out of the full can magazine 4 of the filled can carrier 50 which is filled with cans 20,
- the setting in readiness of an empty can carrier 5 in the full can magazine 4, and
- the setting in readiness of can carrier 51 loaded with empty cans 2 in the empty can magazine 3, can only be carried out after the loading of the can carrier 50 which is in the full can magazine 4. In order to hold the unavoidable production interruption to the shortest time possible, the operating person must execute these steps immediately after the loading of the can carrier 50 with full cans 20.

Based on the above grounds, the procedure described above is changed in such a way that the setting in readiness of a can carrier 52 (FIG. 2*d*) with empty cans 2 in the empty can magazine 3 is done independently as to whether the filling station 1 with the empty can supplying can carrier 5 is already empty or not.

In an analogous manner, the retrieval transport is carried out for a can carrier 50 (FIG. 2*e*) which is loaded with full cans 20, whether the can carrier 5, which has been served by the filling station, is already partially, or even completely, loaded with full cans 20 or not. For this purpose, the empty can magazine 3 as well as the full can magazine 4 pcssess, respectively, an additional place as a buffer station for a further can carrier. The empty can magazine 3 possesses a Supply Station, or buffer place, 32 for the can carrier 5 from which the mentioned supply mechanism 30 forwards the empty cans 2 singly for filling one after the other, timed by the filling activity of the filling station 1. Besides this, the empty an magazine 3 has a Hold Station, or buffer place, 31 inserted ahead of it, to which a new feed of empty can 2 enters with its attendant can carrier 51. This is brought in before it is conducted to the feed position. The full can magazine 4, on its side, possesses a Receiving Station 40 and a buffer or Removal Station 41. The filled cans 20 yielded by the filling station 1 go to an empty can carrier 50 which was placed in readiness on the Receiving Station 40. The can carrier 50, after loading, is switched to the Removal Station 41, where it waits to be taken away.

The four hold position areas,

Hold Station 31 [waiting station]

Supply Station 32 [supply of empty cans]

Receiving Station 40 [receiving full cans]

Removal Station 41 [take away to process]

of the empty can magazine 3 and full can magazine 4 comprise all hold positions of the can magazine 6 as depicted in FIG. 2, and are arranged next to one another.

The individual operational steps of this modified procedure should also be more closely examined in the following. In the indicated start position in accord with FIG. 2*a*, there are found in the empty can magazine 3 can carriers 51, 5 ready with empty cans. The first can carrier 51 with empty cans 2 finds itself at the Hold Station 31 in its buffer or waiting phase, while the other, i.e., can carrier 5, loaded with empty cans, is already in its supply position on the area Supply Station 32 (see FIG. 2*a*).

In the full can magazine 4, on the other hand, on the Receiving Station 40 stands principally an empty can carrier 50 in readiness, while the Removal Station 41 is not occupied.

The supply mechanism 30 (see FIG. 1), which, is designed in a conventional manner and according to the need, may be placed next to a can carrier or even above a can carrier. The supply mechanism 30 now supplies to the filling station 1 one empty can 2 (arrow $f_1$), which, in a known manner, grabs the one can 2 and conveys it under a filling head. In this place, the actual filling process takes place. After the completion of the filling process, the now filled can 20 is further moved along and finally ejected out of the filling station 1 onto the prepared can carrier 50 that is at the receiving point, or the Receiving Station 40. In this way, the supply mechanism 30 runs all empty cans 2, one by one from the can carrier 5 to the filling station 1. The can 20, now full after the completed filling procedure, is ejected from the filling station 1, and moved farther on to the can carrier 50. The can 20 impacts against the last ejected can thereon of the row of cans, which builds up on this carrier, and shoves the entire row of cans away from the filling station until the can carrier 50 is full (FIG. 2*b*).

If all the empty cans from the can carrier 5 in the Supply Station 32 are removed and the can carrier 50, which is on the Receiving Station 40 of the full can magazine 4, is loaded, then, by means of a elevating crossover device 7 (to be described later, see FIGS. 3 and 4), all the can carriers 51, 5, 50 found in the can magazine 6 are lifted and moved sideways through such a displacement that the can carrier 5 transfers from the Supply Station 32 to the Receiving Station 40 (see arrow $f_6$ in FIG. 2*c*).

The two can carriers 51, 50 which neighbor this can carrier 5 are, in the same direction of movement, brought on to the hold position which is adjacent to their starting position. The can carrier 50 with the full cans 20 can enter into the removal area in the Removal Station 41, which up to this point was free. The can carrier 51, which was placed in readiness in the hold position with the empty cans 2, moves onto the supply position 32.

The two middle wait stations, i.e., 32 and 40, which work together with the filling station 1, find themselves again in a normal operational situation. The two outer wait stations, on the other hand, do not become directly a part of the filling process and serve as buffer stations. Thus, it is unimportant if, here, a new can carrier 52 with empty cans 2 is brought in (see arrow $f_5$ in FIG. 2*d*). The can carrier 50 with the full cans 20 should be removed (see arrow $f_2$ of FIG. 2*e*) in the time span between two executed crossover displacements. Thus, this may be carried out in a wide time span without interruption of the filling procedure. It is not significant, whether these "to or from" movements of can carriers occur manually by an operator or fully automatically with the help of an automatic transport and transport control apparatus.

Figure 3:
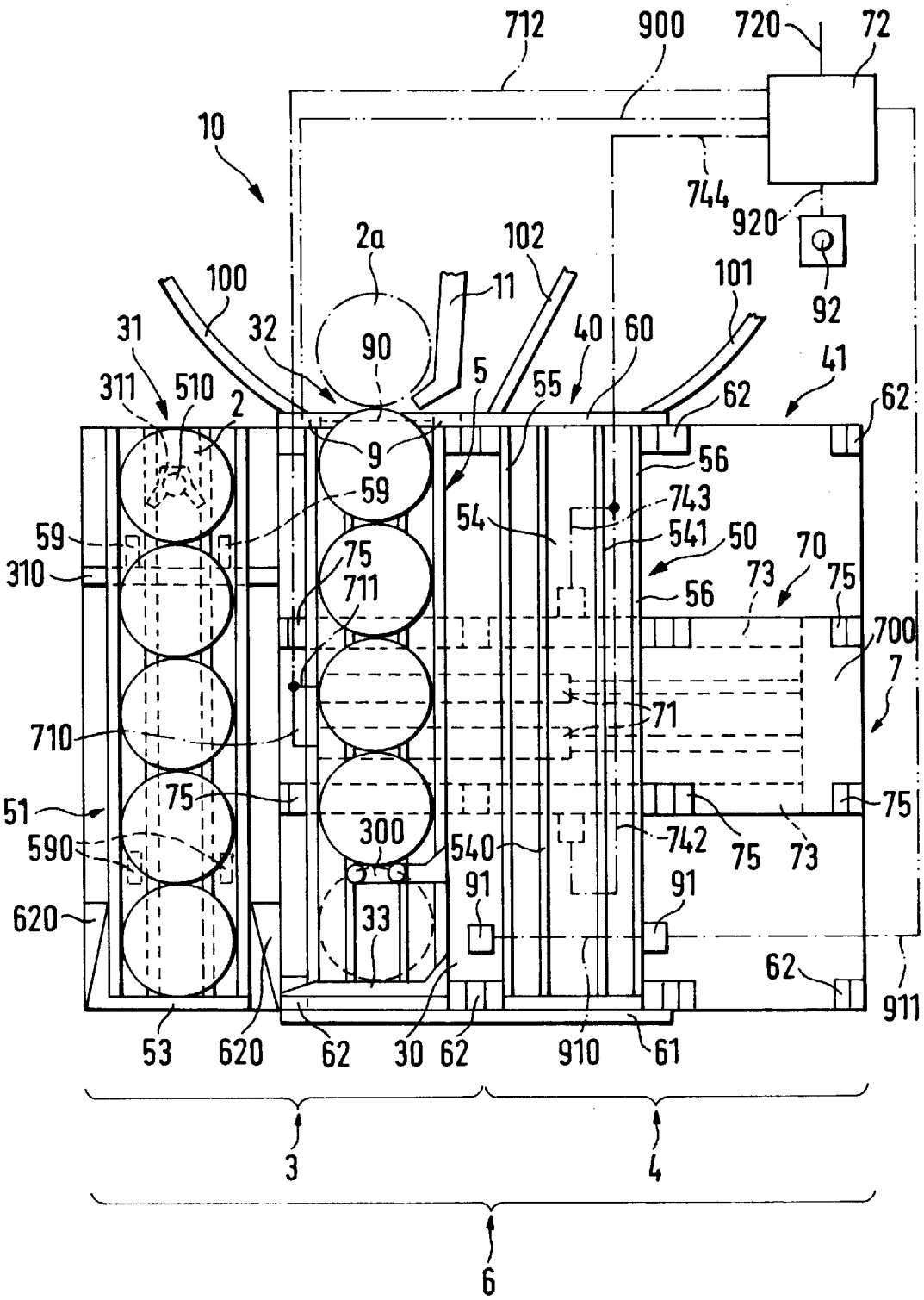
FIG. 3 & FIG. 4 show the preferred embodiment of the invention in plan view and profile, respectively.
Figure 4:
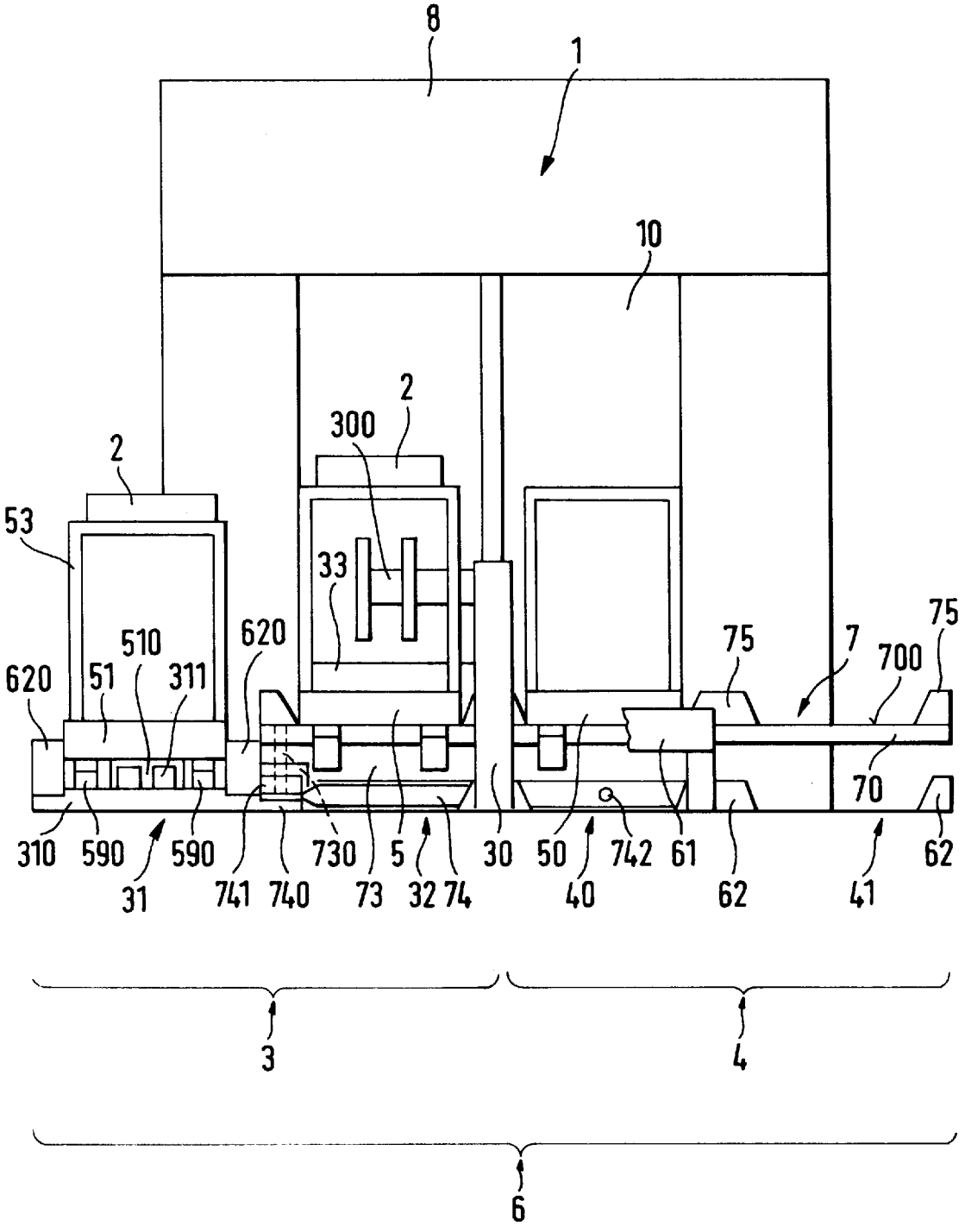

Before a further procedure variant is explained, referring to FIGS. 3 and 4, an apparatus should be described with the help of which the procedure in accord with FIG. 2 maybe brought about. In the presentation of this, elements will be omitted which are not relevant for the understanding of the invention.

In FIG. 3, principally, a section of the can exchange mechanism 10 is presented as a part of the filling station 1 (see FIGS. 1 and 2). This mechanism exhibits a bow shaped can guide 100, which essentially extends from the Supply Station 32 to the (not shown) filling head of the filling station 1. The can exchanger possesses further a rotating come-along arm 11 by which, in FIG. 3 the free, co-acting ends are to be seen embracing the can to be transported (see the pertinent can 2*a*, drawn in dashed lines). Another bow shaped can guide 101 of the can exchanger extends itself from the filling head to the Receiving Station 40. An additional can guide 102 is assigned to the Receiving Station 40 with the purpose of diverting a filled can 20 coming from the filling head out of the circular track of the can exchanger 10 in a direction to the can carrier 50, which carrier is then located on the Receiving Station 40.

The can guides 100, 101 and 102 are placed beneath the operating zone of the rotating come-along arm 11, so that freedom of motion of the come-along arm is not limited.

The can carrier 5, 50, 51, 52 . . . may be designed in any appropriate shape, for instance, as a pallet or the like. In the embodiment shown in FIGS. 3 and 4, a can wagon finds application as can carrier 5, 50, 51, 52 . . . These can carriers exhibit on its end remote from the can exchanger 10 a grabbing yoke 53 extending upwards, with the help of which the can carrier 5, 50, 51, 52 . . . (here a can wagon) may be manipulated by an operating person. From the grab yoke 53 to its end proximal to the filling station, the can carrier 5, 50, 51, 52 . . . (can wagon) has a can hold position 54, which is laterally bounded to guides 55 and 56, in order to hold the cans 2 or 20 in a row. Between these guides 55 and 56, the can hold position 54 has two or more reinforcing strips 540 and 541 in order to reduce the friction between cans 2 or 20 and the can carrier 5, 50, 51, 52 . . . (can wagon).

The described features of the can wagon are clearly recognizable in the case of the can carrier 50 which is to be found on the Receiving Station 40.

The can wagon possesses on its underside, two pairs of wheels 59 and 590. The pair of wheels 59 remote from the grab yoke 53 is not pivotable or turnable. On the other hand, the pair of wheels 590 nearer to the grab yoke 53 is pivotable. In other words, the pair is adaptable to the direction of movement of the can wagon by the swinging of its holding means. In case of necessity, instead of one or the other pairs of wheels 59, 590, even a single caster can find application.

The can magazine 6 has restraining guides 60 and 61. These guides are located respectively, on the proximal and remote sides of the can exchanger 10, thus separated by the length of a can carrier 5, 50, 51, 52 . . . in order to maintain the can carrier 5, 50, 51, 52 . . . , not only on the Supply Station 32, but on the Receiving Station 40, in a defined position in respect to the can exchanger 10.

This assurance of position of the can carrier 5, 50, 51, 52 . . . in the area of the guides 60 and 61 is of considerable importance for an error free function in the conducting of empty cans 2 to the can exchanger 10, as well as in the removal of filled cans 20 from the can exchanger 10.

Further restraining means 62 for the can carriers 5, 50, 51, 52 . . . are arranged on each of the hold positions, (Hold Station 31, Supply Station 32, Receiving Station 40, Removal Station 41) which secure the can carriers 5, 50, 51, 52 . . . at right angles to the can movement to the can exchange 10, as well as to the can 20 movement from the can exchange 10. This restraining means 62 may be designed in various ways, as a comparison of the hold positions (Hold Station 31, Supply Station 32, Receiving Station 40, Removal Station 41) makes clear. As may be plainly seen in FIG. 4, in the three hold positions (32, 40, 41) which follow the Hold Station 31, these restraining means 62 are designed in wedge shape (prisms). The Hold Station 31 on its feed side (i.e., on its remote side from the filling station) possesses two wedge-like positioning guides 620 with the aid of which the can carrier 51 sent to this Hold Station 31 is aligned into an exact specified position. For this purpose, the two positioning guides 620 are designed to fit upon installation to the width of the can carrier 5, 50, 51, 52 . . . , which are to be conducted to the hold position. The Hold Station 31 possesses further a threshold 310, over which the can carrier 51, designed as a can wagon, must roll when it is brought into hold position. For this purpose, a guide bolt 510, provided on the underside of the can wagon, ingresses a stationary, wedge shaped guide 311 which exactly positions the can carrier 51. In order to make a clear presentation on the drawing (FIG. 4), the guide bolt 510 is simply shown on the can carrier 51 which is in a hold position. However, it is self evident that all can carriers 5, 50, 51, 52 . . . are similarly equipped. The threshold 310 together with the guide 311 form, in this arrangement, a restraint for the can carrier 51 in order to positively define its position relative to the can exchanger 10.

The already mentioned feed apparatus, which exhibits a frame 300, is to be found, in accord with FIGS. 3 and 4, between the Supply Station 32 and the Receiving Station 40. The feed frame 300 grips on the end, remote from the filling station 1, of the row of cans, which are arranged on the can carrier 5 on the Supply Station 32. The feed frame 300 shoves the cans 2 to the can exchanger 10 one by one synchronously with the function of the can exchanger.

So that the feed frame 300 can reach the end of the can row remote from the can exchanger with some assuredness, in accord with the apparatus shown in FIGS. 3 and 4, a stationary take-up wedge 33 is provided. The take-up wedge 33 extends itself from that side of Supply Station 32 which is remote from the Hold Station 31 up to direct adjacency to the Hold Station 31 over the full breadth of the Supply Station 32. If, then, a can carrier 5, 50, 51, 52 . . . is transferred from the Hold Station 31 to the Supply Station 32, then a can 2, which is remote from the filling station and is found in the can row on the can carrier 5, abuts the take-up wedge 33. This take-up wedge now shoves the entire can row through a distance of specified dimension in the direction of the can exchanger 10 and creates the necessary space for the introduction of the feeding frame 300. For instance, if this feeding frame 300 finds itself in an extremely pivoted start position, then it can be swung around for the feeding operation as shown in FIG. 3.

In case it is desired, provision may be made allowing the feeding frame 300 to take over the described function of the take-up wedge 33, so that a separate element may be dispensed with.

For the crossover of the can carrier 5, 50, 51, 52 . . . from one position to the neighboring position a crossover apparatus 7 is installed underneath the bottom of the can carrier 5, 50, 51, 52 . . . This crossover apparatus is comprised, in accord with the shown embodiment, essentially of a wagon or sled 70, which is movable at right angles to the supply and removal direction of the can carrier 5, 50, 51, 52 . . . (see arrows $f_5$ and $f_2$ in FIGS. 2*d*, 2*e*). This wagon or sled 70 has a carrying surface for the acceptance of can carriers 5, 50, 51, 52 . . . .

In accord with FIG. 3, the sled 70 is connected with two driving pistons 71, which in turn communicate with a in/out connection or a pressure medium. This connection is indicated by the lines 710, 711, and 712, which are connected with a control device 72. The control device 72 operates in a, control connection with the filling station 1 (see line 720). The sled is on rails 73, or the like, which are upwardly adjustable by means of guides 730 at their ends (FIG. 4). For reasons of clarity, in FIG. 4, only a single guide 730 is shown, although it is self evident that a guide of this kind is furnished on each end of the rail 73. For a lift drive for each of the two rails 73, a hose 74 serves, which is closed by means of clamping elements 740 and 741 at each end. This closed hose 74 is connected by lines 742, 743, 744 with the control device 72. In accord with FIG. 4, the clamping elements 740 and 741 also operate within one of the guides 730 respectively.

In order to prevent the can carrier 5, 50, 51, 52 . . . from moving itself relative to the wagon or sled 70 while the crossover apparatus 7 is operating, a restraining means 75 is provided on the carrying surface of the sled 70, analogous to the stationary restraining means 62 of the can magazine 6. Beyond this, the relative distance of the can carrier 5, 50, 51, 52 . . . to the filling station 1 is secured by the guides 60 and 61, not only when these are on the bottom, but also during the transfer movement from one position to the next.

On the ends of the Supply Station 32 of the empty can magazine 3, which ends are proximal to the can exchanger 10, a monitoring device 9 (FIG. 3) is assigned. This device determines whether or not, the can carrier 5 in that place, at that time, has been emptied, or if a there is still a can 2 thereon. The monitoring device 9 may be designed in various ways. One way would be a counting device, which is preset with the number of cans 2 to be found on a can carrier 5. As each can 2 passes this device 9, a value of "one" is deducted. Upon the reaching of the value of "zero", this situation is announced to the control device 72. Alternate to this, a simple light relay 90 may be put into service, the beam of which is interrupted by the cans 2, until the last can 2 has left the can carrier 5. By means of a line 900, a corresponding signal is sent to the control device 72.

The light relay 90 may be provided not only at right angles to the can movement direction, but also parallel thereto. For example, the light relay 90 light source or photo-diode is arranged on the feed frame 300, and the reception element on an appropriate place on that side of the Supply station 32 which is proximal to the filling station 1.

An additional monitoring device 91, connected with the control device 72 by means of a line 911, is assigned to the Receiving Station 40 of the full can magazine. Monitoring device 91 with the help of a light relay 910 determines whether or not a can carrier 50 in the receiving position is completely loaded with filled cans 20.

The control device 72, which communicates over the line 720 with a control system of the band producing textile machine 8, correlates the operation of the can magazine 6 with the operation of the band yielding textile machine 8. Therefore, the supply mechanism 30, which, in a manner not shown, is connected with the control device 72, can only operate in an cooperative way with the operation of the can exchanger 10.

The presentation of further possibly necessary monitoring systems is omitted, for the sake of clarity.

If all the cans 2 from the can carrier 5, which is in the supply position, are sent to the filling station 1 from the can carrier 5, and also if the can carrier 50 in the receiving position is again fully loaded with newly filled cans 20, then the loaded can carrier 50 must make room, so that the empty can carrier 5 from the supply position in the empty can magazine 3 may be transferred to the receiving position in the full can magazine 4. At the same time, a can carrier 51 with empty cans 2 should come into the supply position, so that the filling operation may be further carried on. In this; way, during this operational phase, three can carriers, namely the emptied can carrier 5 and the neighboring can carriers 51 and 50 are to be moved.

In order to be able to have a timely exchange of the can carrier 5, 50, 51 . . . the crossover apparatus 7, in a next-to-one another-arrangement of the holding area of the can magazine 6, is so designed and so dimensioned, that it is able to transfer all three can carriers 5, 50, 51, . . . simultaneously. For this purpose, the carrying surface 700 of the sled 70 extends over three neighboring positions, that is, over the width of all together reduced by the breadth of one positioning area. In the illustrated idle time, the sled 70 find itself in a lowered position, wherein the carrying surface 700 extends itself from the Supply Station 32 to and beyond the Removal Station 41.

If signal messages from the monitoring devices 9 and 91 have been input to the control device 72, then this releases the crossover guidance of a can carrier from the empty can magazine 3 into the full can magazine 4. This crossover guidance can only be activated after the can carrier arranged in the empty can magazine 3 has been emptied and a can carrier fully loaded with full cans 20 has been removed from out of the full can magazine 4. Next, the control device 72 activates an emptying of one side of the drive piston 71, which now moves the sled 70, which is found in its lowered position underneath the can carrier 5 and 50. The sled 70 is moved out of an idle or waiting state sidewards to the extent of the breadth of a positional hold place, until the sled is under the can carrier 51, 5, and 50 and thus extends inclusively from the waiting position to the receiving position. In this position, the reaching of which may be signaled to the control device 72 through a (not shown) monitoring device, for instance in the form of a limit switch, the control device 72 so acts, that air or another gaseous or liquid medium is opened to two hoses 74. The hoses fill themselves therewith, and at the same time lift the two rails 73, along with the sled 7. In this lifting operation, the sled 70 carries upward the three can carriers 51, 5, 50, which are in its lifting zone. These lifted can carriers 51, 5, 50 are, in this way, brought out of the operating area of the stationary restraint means (guides 311, positioning guides 620 as well as the restraining means 62).

The sled 70 can now be run back into its starting position, whereby it transfers the can carriers 51, 5, and 50, which were carried along with the sled, in such a way, that the can carrier 51 loaded with empty cans 2 is found in the Supply Station, the empty can carrier 5 is in the Receiving Station and the can carrier 50 loaded with full cans 20 is in the Removal Station. After reaching its starting position, the sled 70 is once again lowered as the fluid is let out of the two hoses 74.

During the crossover operation, the can carriers 51, 5, 50 which are assembled on the sled 70 are secured against sideways sliding by the restraining means 75 on the sled 70 and sliding against the can exchanger 10 by the two guides 60 and 61.

From the standpoint of illustrative clarity, for FIG. 4, the point in time of the absolute start of operations was chosen. At this exact time, the two placement positions, which take part in the operation, namely Supply Station 32 and Receiving Station 40, have been loaded by means of the transfer of the wagon or sled 70. This sled 70 is still not lowered. Already, now, the waiting position may be loaded anew by means of a new can carrier 51, as FIG. 4 shows.

If, at a later time, a can carrier loaded with full cans 20 stands ready on the Removal Station 41 to be taken away, then the sled 70 would be temporarily run to the left out of the depicted position in FIGS. 3 and 4. This being done so that the sled 70 makes the Removal Station free. For the inception of this function, at an appropriate position, a switch 92 (FIG. 3) may be provided, which, with the help of line 920 is in controlling contact with the thereto connected control device 72. If the can carrier 50 has left the Removal Station 41 (FIG. 2*e*), then, with the aid of the switch 92, (or another switching means, for instance, a time switch, a light relay, or the like) activity may be initiated in which the wagon or sled 70 returns to its idling or start position, however, without having to be lifted for this return movement, since it carries no can carrier with it.

Since the wagon, or the sled, when it finds itself in its start or idle position, releases the Hold Station 31, it is possible at that place, at an optional time, to set up in readiness, a can carrier 51 with empty cans 2.

The crossover of a can carrier 5, 50, 51, 52 . . . from one position (wait area) to the next, may be done, principally, in an optional manner. Indeed, this may be done in accord with the design of the can magazine 6 singly or in common with other can carriers.

Within the framework of the present invention, the procedure as well as the apparatus may be modified in a multitude of ways. This may be done especially through exchange of single features with equivalents thereto or by other feature combinations. So, it is very true that the crossover of the can carriers in a single direction and consideration of the design of the crossover apparatus 7 brings special advantages. However, this is not the only possibility which may be advanced for the transfer of can carriers 5 from one of the position areas onto the next to be occupied—with consideration given to the operational cycle.

Figure 6:
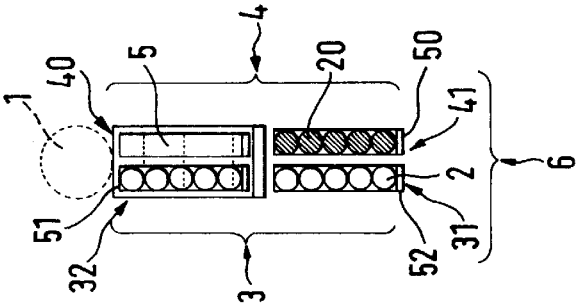
FIG. 6 shows the invention in a schematic presentation in connection with an arrangement of can carriers in front of the filling station in two rows.

Thus, FIG. 6 shows an arrangement, which is, to be preferred in the case of close arrangement of the neighboring filling station 1. In this arrangement, the matter is indifferent as to whether the neighboring filling station 1 belongs to different band producing textile machines 8 (FIG. 4) or is always a pair-wise part of a double headed draw frame. Since, in a case of an unchanged, close arrangement of the filling station 1, to be able to provide a Hold Station 31 as well as a Removal Station 41—in addition to the Supply Station 32 and the Receiving Station 40 with the can carriers which work in conjunction with the filling station 1—these two additional placement areas are not arranged in the same rows as the Hold Station 31 and the Receiving Station 40, but in one preceding row, that is, on the side remote from the filling station 1. The empty can magazine 3 encompasses thus the two left placement areas (Hold Station 31 and Supply Station 32), while the full can magazine 4 encloses the two right placement areas, (Receiving Station 40 and Removal Station 41). In accord with the design of the band producing textile machine 8, and its filling station 1, a mirror image arrangement is also possible.

The operation phase shown in FIG. 6 corresponds to the operational phase in accord with FIG. 2*d*. The empty cans 2 were, with the aid of a not shown feeding mechanism 30 (see FIGS. 1 and 3) of the filling station 1, brought to the filling station 1 and, after the filling process, moved then as filled cans 20 to the can carrier 5, which is in the receiving position. During this elapsing time, the can carrier 50 from the Removal Station 41 must be removed, in order to keep this position free for the later acceptance of the can carrier 5. If the can carrier 5 is loaded, then it will be transferred from its receiving position to the Removal Station 41, which has meanwhile become free. The can carrier 51, which has now become empty, is then transferred from the Supply Station 32 to the Receiving Station 40. In this way, the Supply Station 32 becomes free, to which is brought the can carrier 51 previously deposited on the Hold Station 31. The Hold Station 31 now stands ready for the acceptance of another can carrier, filled with empty cans.

The transfer of a can carrier 5, 50, 51, 52 . . . , from one placed position into the next, may be carried out, for instance, by a (not shown) provided, height adjustable wagon, or the provision of a similar sled, onto which a further wagon or sled may be found. The direction of movement of the stacked wagons or sleds are set at a right angle to one another. For instance, if the lower wagon or sled is movable at right angles to the supply and removal directions of the can carrier 5, 50, 51, 52 . . . , (arrow $f_5$ and $f_2$ in the FIG. 1*c* and 1*f*), then the upper wagon or sled is movable parallel to the supply and removal directions.

The restraints of the can carrier 5, 50, 51, 52 . . . may also, in such a design, be done in a similar manner to that described in connection with FIGS. 3 and 4 (restraint means 62; guides 60, 61; restraint means 75; threshold 310, guides 311).

The restraint means can, however, be designed in deviant manner from the previous descriptive embodiments. In doing this, it is possible, instead of lifting the can carriers out of the active zone of the restraining means, to move the restraining means out of the movement zone of the can carrier.

This procedure would only be done for the duration of the transfer movement, that is, during the placements at the empty can magazine 3, 3*a*. Conversely, this procedure would be done also for the removal of the full can magazine 4, 4*a* out of the movement zone of the can carrier. This procedure/operation is not shown.

In connection with the FIGS. 3 and 4, various means of restraint were described (restraining means 62, positional guides 620, guides 60, 61, threshold 310, guide 311 . . . ). It is self explanatory, that not all these named restraining means must appear in applications simultaneously and in the described or depicted designs. It is even possible to replace these restraining means, or some of them, with feet, instead of the wheel pair 59, 590 of the can carrier 5, 50, 51, 52 . . . , so that the restraint is made secure by the friction between the footings and the surface base. Otherwise, it could have been mentioned above that the restraining means would be appropriate for the size of the can carriers 5, 50, 51, 52 . . . transporting the cans 2, 20. This occurs by substitution or exchange of restraints of this kind. In order not to waste valuable space, it is advisable not to set up a can magazine 6 for all possible sizes which possibly could come into use, but to provide this installation ability simply within a certain framework, that is, for can diameters which do not vary too much from one another.

Principally, instead of a height adjustment for the sled 70, shown in FIGS. 3 and 4, or a sled adaptable for an apparatus in accord with FIG. 6, a simple height adjustment of the carrying surface 700 relative to the sled 70 could be provided. In this case, this height adjustment as well as the sled drive could be carried out by means of motors, ratchet bars, and the like.

It is not required, that the crossover apparatus 7 be located underneath the can carrier. Moreover, the equivalent crossover apparatus 7 may be designed for another place and in a different manner. For instance, on both ends of their operating position in can magazine 6, can carriers may have encompassing transport belts or chains (not shown).

These belts or chains, by means of a belt or chain motivator, may be activated and possess one or more come-alongs with which the can carriers may be impelled to follow the belt or chain movement. A link with the control system would regulate the placement or lifting of the transport connection.

In accord with the described embodiment examples, it is presupposed that the can carriers 5, 50, 51, 52 . . . , to be set inside the can magazine 6, are always picked up as a complete package. This is not unconditionally necessary. Alternatively, it may be provided, that in case of a can carrier designed as a can wagon, with a single pivotable caster, or a swingable caster pair or wheel pair 590 (see FIG. 3) and a single non-pivotable caster, or a second non-pivotable caster-pair or wheel pair 59, generally, the end of the can wagon is tiltable from the floor. This end is remote from the wheel pair which is suited to the movement direction (or a corresponding caster), in order to release the can wagon for the crossover motion of the can wagon from one placement area to another. The other wheel pair 590 (or the corresponding single caster) may, in the mean time, maintain floor contact, which orients the movement direction of the can wagon provides the with can wagon support.

Even so, it is also possible that the can carrier may be seized on each of its ends, each with a respective transport apparatus. This transport apparatus being, for instance, a chain with grippers allows essentially a torque free switch over. In this embodiment, the can carrier, in case all casters are designed as pivotable, is not elevated. In the case of non-pivotable casters, the can carrier is at least raised on that end of the non-pivotable caster. By means of the transport being essentially torque free, the transport apparatus is substantially free of wear and may be made in a lighter type of construction.

As already described above, the can carrier 5, 50, 51, 52 . . . may be designed in various ways. In this way, under certain circumstances, special guide means (guides 55 and 56—see FIG. 3) may be dispensed with, dependent upon the design and method of operation of the supply mechanism 30, which is able to remove the empty cans 2 from the end of a can carrier, which end is proximal to the filling station 1. This may be done without the necessity of shoving the entire row of cans. The same is valid for the slip reducing means (support strips, 540, 541—see FIG. 3) which were constructed, for instance, from a material particularly low in friction such as plastic. In some cases, generally no friction reducing measures are required, especially if the supply apparatus lifts the empty cans 2 upon their presentation at the can exchanger 10.

In the case of the embodiment examples up to now, there were always provided, respectively, two placement areas (Hold Station 31 and Supply Station 32 and Receiving Station 40 and Removal Station 41) for the empty can magazine 3 as well as for the full can magazine 4. The embodiment shown in FIG. 5 demonstrates that it is thoroughly desirable to provide even more buffer stations for the two magazines (empty can magazine 3 and full can magazine 4).

Figure 5:
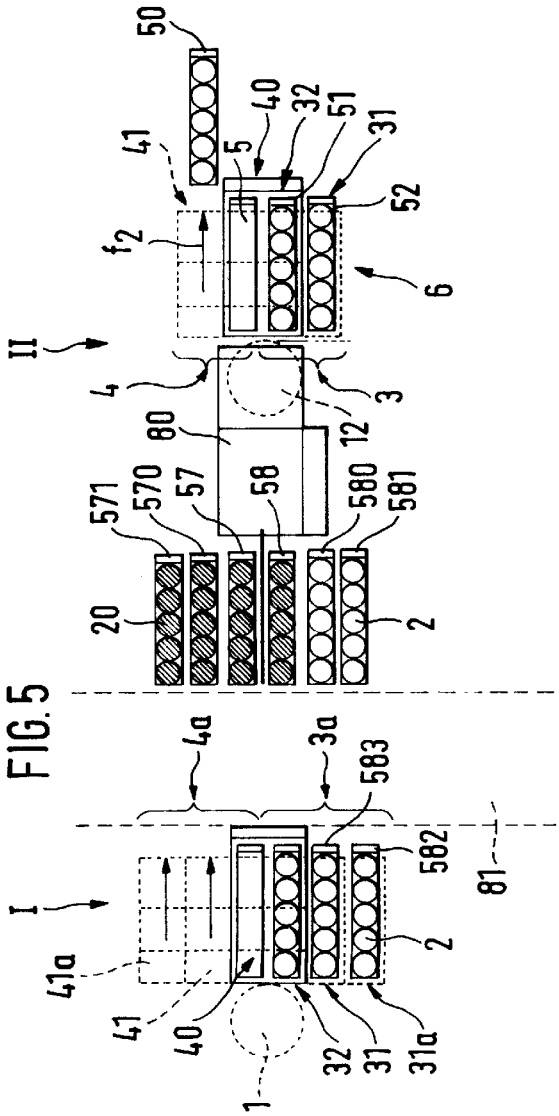
FIG. 5 shows, in a schematic presentation, a further modification apparatus in accord with the invention in connection with two stretch lanes.

FIG. 5 shows two filling stations 1 and 12 following one another in production. Of these, for instance, the first filling station is a part of a first draw frame (not shown), and the second filling station 12 is a part of a second draw frame 80. The first draw frame with the filling station 1 forms a first draw passage I, wherein the second draw frame 80 forms a second draw passage II. The can magazine 6 of this second draw passage II may be so constructed as has been previously explained with the aid of FIGS. 2 to 4. On the entry side of this second draw passage II, are found two can carriers 57 and 58 with full cans 20, the bands of which (not shown) are supplied to the stretch machine 80. On the one side, beside these two can carriers 57 and 58 are located two further can carriers 570 and 571 with full cans 20, which are to occupy the places of the can carriers 57 and 58 as soon as the cans 20 of these carriers are emptied. On the other side of the can carriers 57 and 58 are found two further can carriers 580 and 581. The cans 2 of can carriers 580 and 581 have just been emptied on the draw frame.

The first draw passage I shows as buffers, in its empty can magazine 3*a*, a total of two Hold Stations 31 and 31*a* and in its full can magazine 4*a*, two Removal Stations 41 and 41*a*.

For the operation of the second draw passage II, the second draw frame 80 must always have two can carriers 57 and 58 standing simultaneously available. In this matter, it is good to consider arranging the corresponding magazines of the second draw passage II of the draw frame 80 in order to collect the can carriers in pairs.

But in accord with FIG. 5, it was done otherwise. Here it is assured, that the necessary can carriers 57 and 513 which are loaded with full cans 20 are continually supplied, pairwise, to the draw frame 80 and, correspondingly, also pairwise, again removed from the draw frame.

The ejected can carriers 582 and 583 from the draw frame 80 of the second draw passage II, arrive, thus pairwise again, in the empty can magazine 3*a* of the first draw passage I. They are deposited on the two waiting position areas Hold Station 31 and 31*a*. One can carrier after the other is then singly transferred from one position to the next. In the full can magazine 4, the can carriers are first assembled and set down, and only then, when a pair is complete, is it further sent, as a pair, to the second draw passage II.

As a rule, the two draw passages I and II do not operate synchronously. For this reason, as is indicated in FIG. 5 between the draw frame of the first draw passage and the draw frame 80 of the second draw passage II, an apportioning track 81 is interposed. This track provides the possibility that can carriers from various draw frames of the first draw passage I may be supplied, according to need to various draw frames 80 of the second draw passage II.

By means of the above described design of the two draw passages I and II, the possibility does not have to be excluded, that only single can carriers may be brought from one draw frame of the first draw passage I to a draw frame 80 of the second draw passage II. This possibility allows simultaneous availability of can carriers from different draw frames of the first draw passage I to a draw frame 80 of the second draw passage II, for instance, to be able to mix fiber bands of various quality.

Figure 7:
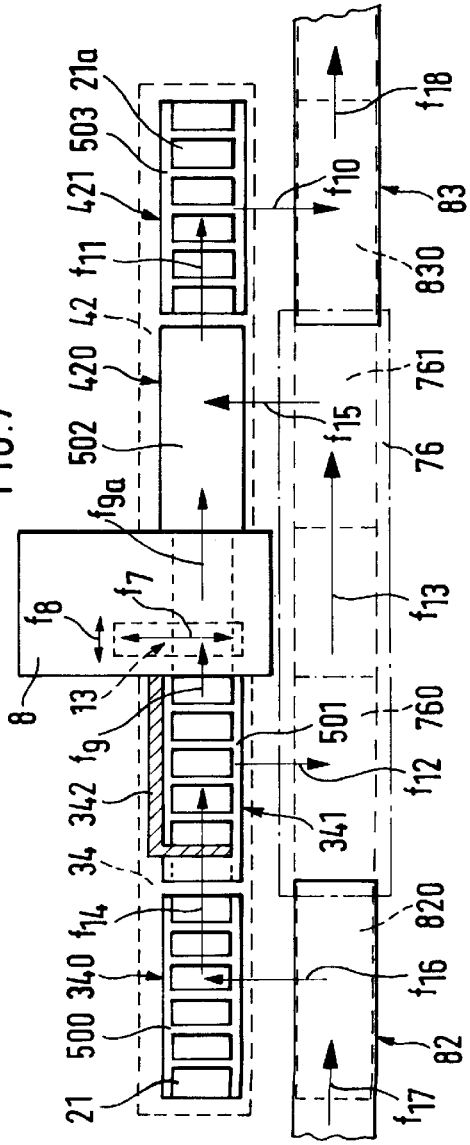
FIG. 7 shows a further modification of the invented apparatus in connection with so-called "flat" or rectangular cans.

Previously, embodiment examples for the manipulation and for the filling of round cans 2, 2*a*, 20 were described. Yet, the invention is not limited to this design. FIG. 7 shows a further modification, which is specially adapted for the supply of so called flat cans, or rectangular cans 21, to a filling station 13 and for the placing in readiness of rectangular full cans 21*a* of this type for removal. The filling station 13 is, in this embodiment, so designed in a manner customary for the flat or rectangular cans 21. The rectangular can 21, during the filling, undergoes a transverse motion (see double arrow $f_7$) in the direction of its greater axis. While this movement is proceeding, a back and forth motion is imparted at right angles thereto (see double arrow $f_8$).

On the supply side of the filling station 13, there is located an empty can magazine 34 with a waiting position 340 and the supply position 341, to which a supply mechanism 342 is assigned. On the removal side of the filling station 13, there is a full can magazine 42 with a receiving position 420 and a removal position 421.

The four positions 340, 341, 420 and 421 of the two can magazines 34 and 42 are, in the drawn example, arranged along a line. Parallel to this, a transfer apparatus 76, for instance, in the form of a conveyor belt, is found. In the extension of the transfer apparatus 16, a can forwarding path 82 is found, while on the removal side, a can carrier removal track 83 is provided. Both the can carrier supply track 82 and the can carrier removal track 83 may be so designed, so that can carrier may be transported automatically in a known manner, However, a track in the form of a path without any particular marking or design, also may be furnished. Along this track, an operating person can bring a can carrier 500 into a readiness position 820 (see arrow $f_{17}$) from which position, after the freeing of the holding position 340, can transfer the carrier 500 thereto. This transfer may be done in an optional manner through the operating person or an automatic apparatus. In analogous mariner, a can carrier 503 placed ready for removal on the removal position 421 may be transferred in a corresponding way from the removal position 421 to a removal ready position 830. From the removal ready position 830, can carrier 503 can be removed by an operator or an appropriate transport apparatus (for instance, a self running wagon or the like).

In each case, according to the design of the can supply path 82, the readiness position 820 may be formed by the waiting position 340. In an anlogouss manner, the removal position 421 can coincide with the removal readiness position 830.

The apparatus now described in its construction in accord with FIG. 7, operates in the following manner.

The assumption is made that the situation presented in FIG. 7 is given as a starting point. Thus, by means of the operation of the supply mechanism 342, a rectangular can 21, which is on a can carrier 501 in the supply position 341, is taken to the operational zone of the filling station 13 (see arrow $f_9$) and may be filled there. In doing this, the rectangular can 21, in a conventional manner, is subjected to transverse agitation inside the filling station 13 (see double arrow $f_7$) and, when required, this transverse motion is overlaid with a to and from motion (see arrow $f_8$). When the rectangular can 21 is filled, then, by a not shown ejection means, which is a component of the filling station 13, the can 21 is pushed out of the filling station 13 in the direction of the arrow $f_{9a}$ onto the can carrier 502, where the filled cans 21 are collected until the can carrier 502 is full. The filling station 13 can also be arranged outside of the transfer wagon. In the case of this example embodiment, an additional can exchanger is required.

At an earlier point in time, during the filling of the removable rectangular can 21*a* on the can carrier 502, loaded can carrier 503 is removed from the removal placement are 421. It is either directly transported away from here, or, in the case previously provided, transferred over into the removal readiness holding station 830 (see arrow $f_{10}$).

When the can carrier 502 is completely full, then the removal position 421 is free to accept it. The can carrier 502 is now transferred from the receiving position 420 in the direction of the arrow $f_{11}$ onto the removal position 421 which has previously become free.

While the last rectangular can 21 is still in the filling station 13 after being taken from the can carrier 501, to the filling station 13, the emptied can carrier 501 is given over to the crossover device 76 (see crossover position, 760) in the direction of the arrow $f_{12}$ by a means not shown. The device 76 brings the can carrier 501 in the direction of the arrow $f_{13}$ into a receiving wait station 761.

Since now the supply position 341 is empty, the empty rectangular cans with their can carrier, which is now on the waiting position 340, may be transferred onto the supply position 341 (see arrow $f_{14}$). This occurs during the time in which the last rectangular can 21 of the previously emptied can carrier 501 is still in the filling station 13. After the filling thereof, without interruption of production, immediately a new rectangular can 21, now from the can carrier 500, is brought to the filling station 13.

As soon as the can carrier 502 with full rectangular cans 21 is fully loaded, and is brought away from the reception position 420 to the removal position 421, then the previously emptied can carrier 501 is transferred out of the receiving wait station 761 into the receiving position 420 (arrow $f_{15}$). This transfer happens during the time in which the first rectangular can 21 of the follow-up can carrier 500 is filled, so that the filling station, without interruption of production, can relinquish the filled rectangular can 21*a* to the ready set can carrier 501 which has come to the receiving position 420.

While the rectangular can 21 from the can carrier 500 is sent to the filling station 13 to be filled, a ready new can carrier (not shown) has been transferred in a direction of the arrow $f_{16}$ from the ready set position 820 to the waiting position 340.

The special design of the (not shown) apparatuses for the transfer of the can carriers 500 to 503 out of or into one of the mentioned positions 820 to 830, that is, the bringing of one of the can carriers onto the one or the other of the positions 340, 341, 420 or 421, may be constructively solved in optional ways. In that matter, the relative arrangement of the positional areas 340, 341, 420 or 421 as well as the provision of the positions 820 or 830 play no important role. Thus, arrangements in accord with the FIGS. 1, 2, 5 or 6 are entirely possible even in connection with flat or rectangular cans.

It will be appreciated by those skilled in the art that various modifications and variations can be made in the present invention without departing from the scope of the invention. It is intended that the present invention include such modifications and variations as come within the scope of the appended claims and their equivalents.

What is claimed is:

1. A process for transporting cans to and from a filling station of a textile machine which produces fiber bands, the process comprising:

depositing filled cans that are leaving the filling station onto a can carrier which is located in a full can magazine of the e textile machine;

simultaneously guiding empty cans from a can carrier located in an empty can magazine of the textile machine to the filling station;

removing the can carrier in the full can magazine from the full can magazine upon a specified plurality of filled cans being deposited on the can carrier; and moving the can carrier in the empty can magazine with a lift crossover device by lifting the can carrier and moving the can carrier sideways into the full can magazine when the empty cans are removed from the can carrier in the empty can magazine and the full can magazine is empty.

2. A process as in claim 1, further comprising restraining the can carrier in the empty can magazine.

3. A process as in claim 2, further comprising restraining the can carrier in the full can magazine.

4. A process as in claim 1, further comprising conveying a can carrier carrying a specified plurality of empty cans to a hold station within the empty can magazine.

5. A process as in claim 4, further comprising transporting the can carrier carrying empty cans located in the hold station to a supply station within the empty can magazine for the individual presentation of empty cans at the filling station.

6. A process as in claim 5, further comprising transporting a can carrier, which is supplying empty cans to the filling station, located in the supply station within the empty can magazine to a receiving station within the full can magazine once the can carrier is void of empty cans.

7. A process as in claim 6, further comprising transporting the can carrier, which is located in a receiving station within the full can magazine and has been loaded with filled cans, from the receiving station to a removal station within the full can magazine.

8. A process as in claim 7, wherein the transporting of the can carriers in the hold station and the supply station within the empty can magazine and the can carrier in the receiving station within the full can magazine occurs simultaneously.

9. A process as in claim 1, wherein the moving sideways of the can carriers from one station to the next occurs at right angles to the direction of the can carrier entering the hold station within the empty can magazine and the can carriers leaving the removal station in the full can magazine.

10. An apparatus for transporting cans to and from a filling station of a textile machine which produces fiber bands, said apparatus comprising:

an empty can magazine into which a can carrier accommodating empty cans enter to supply said filling station with empty cans until said can carrier is void of cans;

a supply mechanism for aiding delivery of one single empty can at a time from said can carrier located in said empty can magazine to said filling station of said textile machine;

a full can magazine in which filled cans leaving said filling station are deposited onto a can carrier located in said full can magazine until said can carrier is filled with a specified plurality of cans; and a crossover apparatus for transferring said can carrier that is void of cans in said empty can magazine to said full can magazine by at least partially lifting said can carrier and transporting it sideways into said full can magazine.

11. An apparatus as in claim 10, further comprising of restraining means located in said empty and full can magazines to aid in retaining said can carriers which are entering each respectively.

12. An apparatus as in claim 10, wherein said crossover apparatus is movable underneath said can carriers located in said empty and full car magazines.

13. An apparatus as in claim 10, wherein the empty can magazine possesses at least one hold station for accepting can carriers carrying empty cans, and a supply station, for accommodating said can carrier carrying the empty cans, from which said empty cans are movable to said filling station.

14. An apparatus as in claim 13, wherein said full can magazine possesses a receiving station for accommodating said can carrier which receives filled cans depositing from said filling station, and at least one removal station for allowing can carriers fully loaded with a specified plurality of filled cans to be transported away for said textile machine.

15. An apparatus as in claim 14, wherein said stations in said empty can magazine and said full can magazine are disposed parallel to one another.

16. An apparatus as in claim 15, wherein said crossover apparatus extends underneath said adjacently positioned stations in said empty can magazine and said full can magazine, and wherein said crossover apparatus's length extends the width of all but one of said stations.

17. An apparatus as in claim 16, wherein said crossover apparatus is movable the distance of the width of one of said stations in two directions which are perpendicular to the directions in which said can carriers enter said empty can magazine and leave said full can magazine.

18. An apparatus as in claim 17, wherein said crossover apparatus is movable toward said full can magazine conveying said can carriers located in said empty can magazine in such a manner that said can carrier in said empty can magazine crosses over into said full can magazine.

19. An apparatus as in claim 17, wherein said crossover apparatus is movable toward said hold station of said empty can magazine without displacing said can carriers located in said empty can magazine or said full can magazine.

20. An apparatus as in claim 19, wherein said crossover apparatus is movable toward said removal station of said full can magazine conveying all said can carriers located in said hold station, said supply station, and said receiving station in such a manner that said can carrier full of empty cans in said hold station is transferred one station to said supply station; said can carrier void of any cans in said supply station is transferred one station to said receiving station; and said can carrier fully loaded with filled cans is transferred one station to said removal station.

21. An apparatus as in claim 10, wherein said empty can magazine and said full can magazine are placed disposably parallel to one another.

22. An apparatus as in claim 10, wherein said can carriers are designed as can wagons and possess at least one caster, which is orientable to the direction of movement of said can wagons, and said crossover apparatus possesses a lifting device which can lift at least one end of said can wagons remote from said orientable caster when said can wagons are located in said empty and full can magazines.

23. An apparatus as in claim 10, wherein said crossover apparatus interacts with a guide vertically adjustable with a lift apparatus in the form of an inflatable hose.

24. An apparatus as in claim 10, wherein said crossover apparatus possesses installable slip restraint, devices for securement of said can carriers.

25. An apparatus as in claim 10, further comprising guides for assuring relative distance between said can carriers and said filling station, and guiding said can carriers crossover transport from said empty can magazine to said full can magazine, said guides extending parallel to the directional movement of said crossover apparatus.

26. An apparatus as in claim 10, further comprising a first monitoring device, which is integral to said empty can magazine, for monitoring can removal from said can carrier in said empty can magazine to said filling station.

27. An apparatus as in claim 26, further comprising a second monitoring device, which is integral to said full can magazine, for monitoring can acceptance from said filling station to said can carrier in said full can magazine.

28. An apparatus as in claim 27, wherein said first and second monitoring device feed information to a control device which controls said crossover apparatus for determining when said crossover apparatus should be activated.

29. An apparatus as in claim 10, wherein said can carriers contain guide means to keep said cans in an orderly formation.

30. An apparatus as in claim 29, wherein said can carriers contain slip restraint means to prevent cans from slipping.

31. An apparatus as in claim 10, wherein said filling station possesses a can exchanger for engaging said can advanced by said supply mechanism from said can carrier in said empty can magazine to said filling station and for transporting said filled cans from said filling station to said can carrier in said full can magazine.

* * * * *